US008953815B2

(12) United States Patent
Shinozaki

(10) Patent No.: US 8,953,815 B2
(45) Date of Patent: Feb. 10, 2015

(54) BATTERY RECEIVING MECHANISM FOR NOISE CANCELLATION HEADPHONE

(75) Inventor: Ryuji Shinozaki, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1120 days.

(21) Appl. No.: 12/949,060

(22) Filed: Nov. 18, 2010

(65) Prior Publication Data

US 2011/0142249 A1 Jun. 16, 2011

(30) Foreign Application Priority Data

Dec. 11, 2009 (JP) ..... 2009-282235

(51) Int. Cl.

| | |
|---|---|
| ***A61F 11/06*** | (2006.01) |
| ***G10K 11/16*** | (2006.01) |
| ***H03B 29/00*** | (2006.01) |
| ***H04R 1/10*** | (2006.01) |

(52) U.S. Cl.

CPC ..... *H04R 1/1091* (2013.01); *H04R 1/1008* (2013.01); *H04R 1/1058* (2013.01); *H04R 1/1083* (2013.01); *H04R 2460/01* (2013.01)

USPC ..... 381/71.6; 381/72; 381/384; 381/74

(58) Field of Classification Search

CPC .. H04R 1/1091; H04R 1/1008; H04R 1/1058; H04R 1/1083; H04R 2460/01; H04R 5/033; G10K 2210/1081

USPC ..... 381/71.6, 71.1, 384, 370, 182, 150, 72, 381/74, 323; 455/575.2

See application file for complete search history.

(56) References Cited

U.S. PATENT DOCUMENTS

| | | | | |
|---|---|---|---|---|
| 6,522,613 | B1 * | 2/2003 | Frankeny et al. | 720/655 |
| 2006/0147794 | A1 * | 7/2006 | Hakunti et al. | 429/100 |
| 2008/0069391 | A1 * | 3/2008 | Steyn et al. | 381/371 |

FOREIGN PATENT DOCUMENTS

| | | |
|---|---|---|
| JP | 5-58441 U | 8/1993 |
| JP | 5-73856 U | 10/1993 |
| JP | 2008-160796 | 7/2008 |

* cited by examiner

*Primary Examiner* — Vivian Chin
*Assistant Examiner* — Con P Tran
(74) *Attorney, Agent, or Firm* — Whitham Curtis Christofferson & Cook, PC

(57) ABSTRACT

Housings on the right/left of the noise cancellation headphone, where a speaker unit is incorporated, are connected to each other with a headband, and a battery receiving portion is provided on a side surface of at least one of the right and left housings. The battery receiving mechanism includes: a battery receiving portion provided in the side surface of the housing; a battery lid opening and closing the battery receiving portion; and a flexible connecting member preventing the battery lid from dropping off from the housing in a state where the battery lid opens the battery receiving portion. The housing and the battery lid each include an engagement part which engages with each other by pushing in the battery lid in a direction intersecting with the side surface of the housing, and the battery lid occupies a part of the side surface of the housing.

6 Claims, 13 Drawing Sheets

BATTERY RECEIVING MECHANISM FOR NOISE CANCELLATION HEADPHONE

BACKGROUND OF THE INVENTION

1. Field of the Invention

The present invention relates to a battery receiving mechanism for a noise cancellation headphone and, in particular, relates to the battery receiving mechanism characterized by the structure of a battery lid.

2. Related Background of the Invention

There are various devices using a battery as the power supply. For example, an active noise cancellation headphone or an earmuff (hereinafter, the headphone or ear muff is referred to as the "headphone or the like"), which actively cancels out environmental noise so as to prevent a user from hearing the same, detects environmental noise with a microphone, outputs a noise signal, and drives a speaker unit with the use of a cancellation signal which is the noise signal whose phase has been inverted. Therefore, in the active noise cancellation type headphone or the like, a battery is used as the power supply for driving a noise canceling circuit, and a battery receiving portion and a lid covering this battery receiving portion are provided in either one of the right and left housings for the headphone or the like.

A user mounts the headphone or the like on his/her head and the headphone or the like moves with the movement of the user. Depending on the circumstances, the headphone or the like violently moves due to a violent movement of a user. Therefore, the battery receiving mechanism in the headphone or the like needs to stably hold the battery even if the headphone or the like violently moves and, in particular, the lid covering the battery receiving portion is required not to be removed even if the headphone or the like violently vibrates. On the other hand, preferably, the battery can be easily replaced.

An example of prior art related to the battery receiving mechanism in the headphone or the like include a battery lid described in Japanese Patent Laid-Open No. 2008-160796. In the battery lid described in Japanese Patent Laid-Open No. 2008-160796, a recessed part for receiving a battery is formed in the side part of an ear cup assembly of the headphone or the like, and this recessed part is enabled to slide between an open position to open the recessed part and a closed position to cover the recessed part. In an embodiment, there is described a battery lid, wherein a battery is attached and detached by circumferentially rotating, sliding, and moving the battery lid so as to protrude from the outer surface of the housing of the ear cup and wherein the recessed part is covered by circumferentially rotating, sliding, and moving the battery lid. The above-described rotating and sliding movement is performed in a plane parallel to the surface of the ear cup, thus, ensuring operability is reasonable.

The battery lid described in Japanese Patent Laid-Open No. 2008-160796 covers the side part of the ear cup assembly, more specifically the outer surface of the ear cup assembly, i.e., the almost whole side surface opposite to the ear pad mounting side. Accordingly, in handling the headphone or the like, hands accordingly touch the battery lid, and if a force to touch the battery lid is large and the direction of this force is the direction to open the battery receiving portion, then the battery lid unexpectedly opens the battery receiving portion and the battery may be removed. Although the rotating and sliding range of the battery lid is restricted to a certain range, an application of a large force to rotate the battery lid beyond the above-described sliding range might damage the battery lid. The battery lid described in Japanese Patent Laid-Open No. 2008-160796 also has a drawback that if the headphone or the like is dropped, the drop impact reaches the battery lid and the sliding mechanism for the battery lid causing, the battery lid and the sliding mechanism for the battery lid to likely be damaged. Moreover, because the battery receiving portion is configured to be opened and closed by sliding and moving the battery lid relative to the side part of the ear cup assembly, a guide structure for sliding and moving the battery lid, a stopper for restricting the sliding range to a certain range, or the like is required and thus the structure has a drawback of becoming complicated.

SUMMARY OF THE INVENTION

The present invention resolves the problems of the prior art represented by the battery lid described in Japanese Patent Laid-Open No. 20081 60796, and provides a battery receiving mechanism with a simple structure for a noise cancellation headphone, wherein even if a large external force is unexpectedly applied to the battery lid, the battery lid does not open the battery receiving portion or the battery lid does not be become damaged.

According to the most principal feature of the present invention, a battery receiving mechanism for a noise cancellation headphone, in which the noise cancellation headphone includes, respectively, on the right and left thereof, a housing containing a speaker unit incorporated therein, both housings are connected to each other with a headband, and a battery receiving portion is provided on a side surface of at least one of the right and left housings. The battery receiving mechanism comprises: a battery lid opening and closing the battery receiving portion, and a flexible connecting member preventing the battery lid from dropping off from the housing in a state where the battery lid opens the battery receiving portion, wherein the housing and the battery lid each include an engagement part which engages with each other by pushing in the battery lid in a direction intersecting with the side surface of the housing, and wherein the battery lid occupies only a part of the side surface of the housing.

Since the engagement part of the battery lid engages with the engagement part of the housing by pushing the battery lid into the side surface of the housing in a direction intersecting with the side surface of the housing, unless the battery lid is intentionally removed from the housing, the battery lid does not open the battery receiving portion even if a large force is unexpectedly applied to the battery lid. For the operation mode of the battery lid, there is only a mode to cover the battery receiving portion or a mode to open the receiving portion. There is no need to provide a member or mechanism for guiding the battery lid in an intermediate state between these modes. Therefore the structure is simple. Since the structure is simple as described above, even if a large impact force is applied to the battery lid, the battery lid is not removed. Even if the battery lid is removed by any chance, the connecting member prevents the battery lid from dropping out of the housing, and thus the battery lid is not damaged.

DESCRIPTION OF THE PREFERRED EMBODIMENTS

Hereinafter, an embodiment of a battery receiving mechanism for a noise cancellation headphone according to the present invention will be described with reference to the accompanying drawings.

Figure 13:
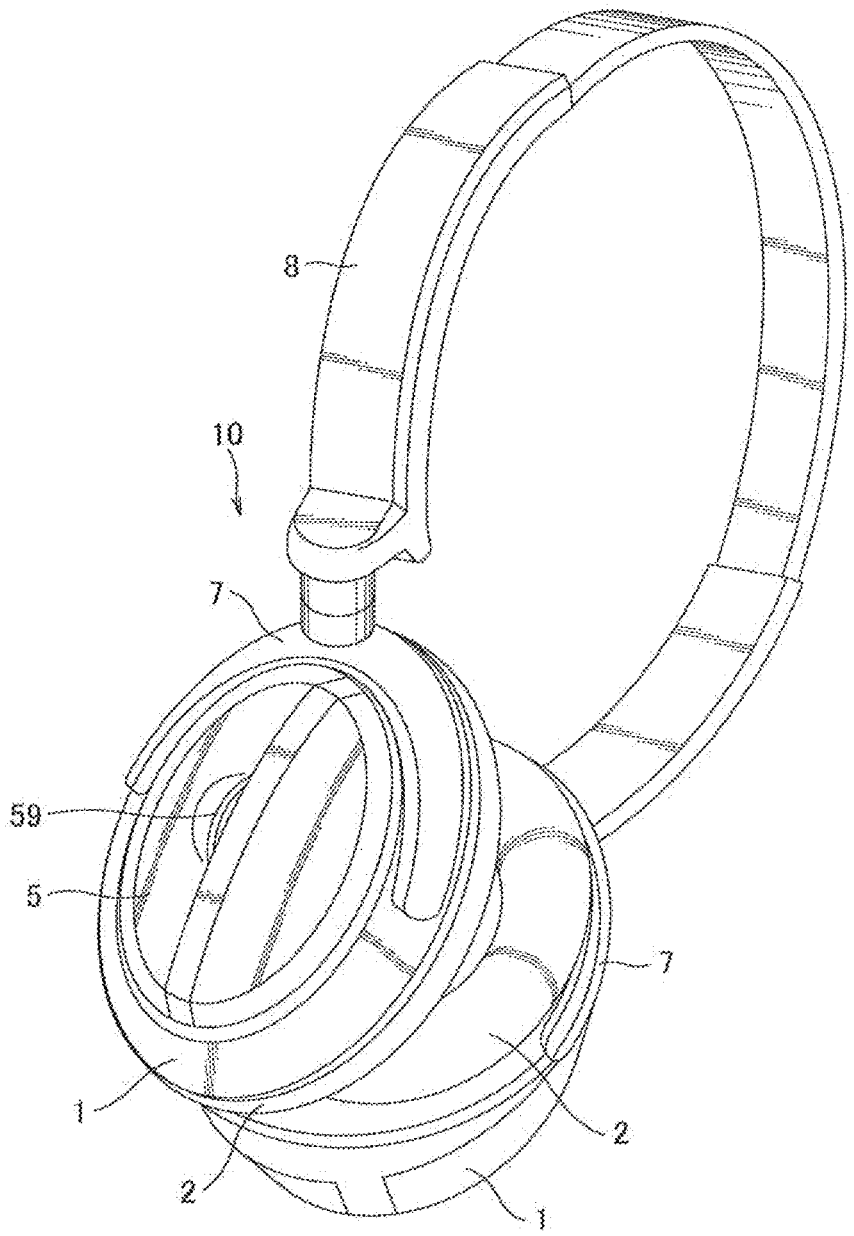
FIG. 13 is a perspective view showing an embodiment of a headphone including the battery receiving mechanism according to the present invention.

Since, in the illustrated embodiment, an active noise cancellation headphone is assumed, a brief overview of the active noise cancellation headphone will be provided first with reference to FIG. 13.

Embodiment

In FIG. 13, a headphone 10 includes, respectively on the right and left thereof, an elliptic housing 1 having a speaker unit incorporated therein. On the sound emission surface side of the speaker unit, two ear pads 2 are firmly fixed to the right and left housings 1, respectively. In the case of a circumaural headphone, the ear pad 2 covers the ear of a user, while in the case of a supra-aural headphone, the ear pad 2 rests on the ear of a user. In the upper part of each housing 1, a hanger 7 is arranged so as to follow along an approximately semicircle in the outer circumference of the housing 1, and both ends of the hanger 7 are connected to the side surface of the housing 1 with a shaft, so that the hanger 7 and the housing 1 are relatively rotatably connected centering around this shaft. The center part in the length direction of each semi-elliptic hanger 7 is connected to both ends of the headband 8. Therefore, each housing 1 is connected by means of the headband 8 via the hanger 7.

The headband 8 is formed in the shape of an arch so as to be able to stride over the head of a user, by using an elastic material. The elasticity of the headband 8 urges the right and left housings 1 in a direction of approaching each other, so that when a user mounts the headphone 10 on his/her head, the housing 1 may be pressed against the user's temporal part at a suitable pressure via the ear pad 2. The headphone 10 is an active noise cancellation headphone which detects environmental noise with a microphone incorporated in the housing 1, and generates a cancellation signal which is the detected noise signal whose phase has been inverted, and cancels out the environmental noise by driving the speaker unit by using this cancellation signal so that the user may not hear the environmental noise.

A power supply is required to activate the active noise cancellation headphone, and thus a battery is loaded as the power supply. The battery is stored in the battery receiving portion provided in at least one of the right and left housings 1, and the battery receiving portion is opened and closed by the battery lid. In the example shown in FIG. 13, a substantially left half of the outer surface of one of the housings 1 is a battery lid 5, and the battery receiving portion is opened/closed by attaching/detaching the battery lid 5. Note that the battery receiving portion may be provided on the right side of the outer surface of the housing 1 or on the upper or lower side thereof so as to open and close this battery receiving portion by the battery lid.

The embodiment shown in FIG. 13 has been described as an example of the active noise cancellation headphone. When a sound signal such as a music or the like is inputted from a sound source such as a music player or the like, the sound signal is reproduced by the speaker unit and the reproduced sound such as the music or the like can be heard under a quiet environment where undesired noise has been canceled out.

The embodiment shown in FIG. 13 may be configured not as the headphone, but as an active noise cancellation ear muff which does not have an input terminal for a sound signal but has only an environmental noise cancellation function. Since the power supply for driving the noise canceling circuit is required also in this case, the battery receiving portion is provided in at least one of the housings 1 and the battery lid 5 opening and closing this battery receiving portion is provided.

Next, an embodiment of the battery receiving mechanism including the battery receiving portion and the battery lid opening and closing this battery receiving portion will be described.

FIG. 1 to FIG. 5 show the one housing having the battery receiving portion among the housings 1 paired on the right and left sides of the headphone 10 shown in FIG. 13. The ring-shaped ear pad 2 is mounted on the sound emission surface side of the speaker unit incorporated in the housing 1. Hereinafter, the ear pad mounting surface side of the housing 1 is referred to as the inner surface side, and the opposite side is referred to as the outer surface side. On the outer surface side of the housing 1, the battery lid 5 capable of opening and closing a substantially half of this outer surface is detachably arranged. The battery receiving portion 3 is provided inside a portion, which is opened and closed by the battery lid 5, of the housing 1. The shape of the outer surface of the housing 1 in this embodiment is elliptic, and a part of the elliptic outer surface is formed by the battery lid 5. Accordingly, the shape of the battery lid 5 viewed from the outer surface direction of the housing 1 is semi-elliptic. Furthermore, since a battery 4 in the battery receiving portion 3 is loaded with a part thereof projecting from the battery receiving portion 3, the battery lid 5 has a semi-elliptic dish shape made by cutting a flat elliptic dish approximately in half and inverting this half dish, so as to be able to cover the projecting battery 4.

Figure 1:
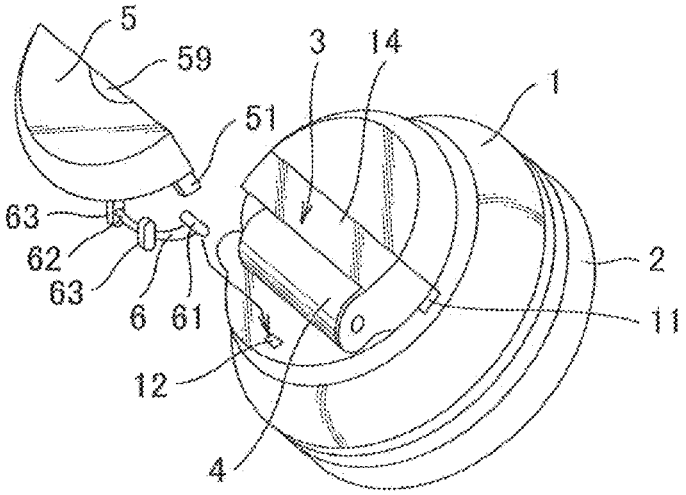
FIG. 1 is an exploded perspective view illustrating a battery receiving mechanism portion of an embodiment of a battery receiving mechanism for a noise cancellation headphone according to the present invention.
Figure 2:
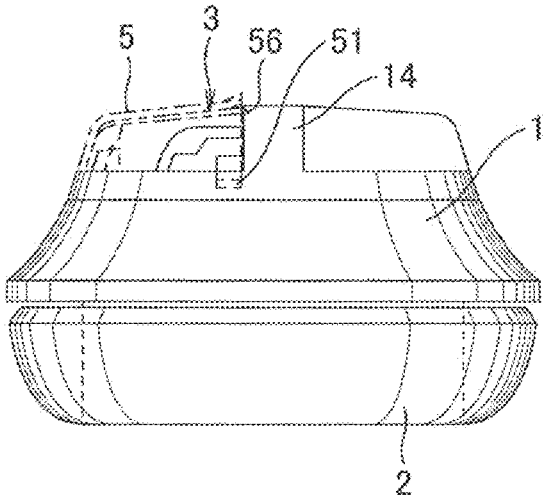
FIG. 2 is a side view of the noise cancellation headphone, in which the battery receiving mechanism portion is indicated by an imaginary line.
Figure 3:
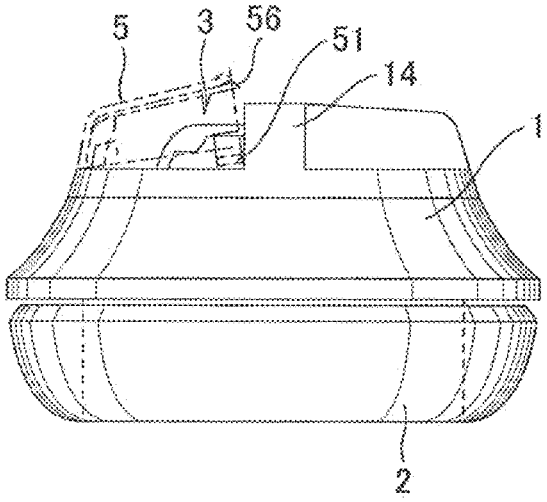
FIG. 3 is a side view of the noise cancellation headphone, in which a part of a different operation mode of the battery receiving mechanism is indicated by an imaginary line.
Figure 4:
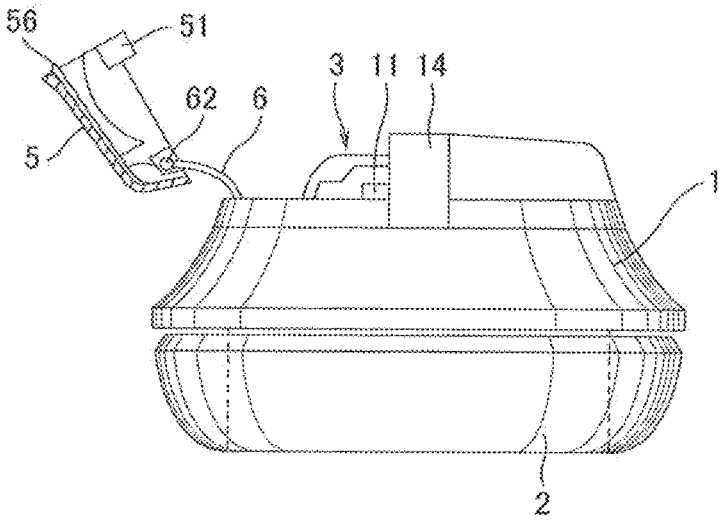
FIG. 4 is a partial cross-sectional side view of the noise cancellation headphone showing yet another operation mode of the battery receiving mechanism.
Figure 6:
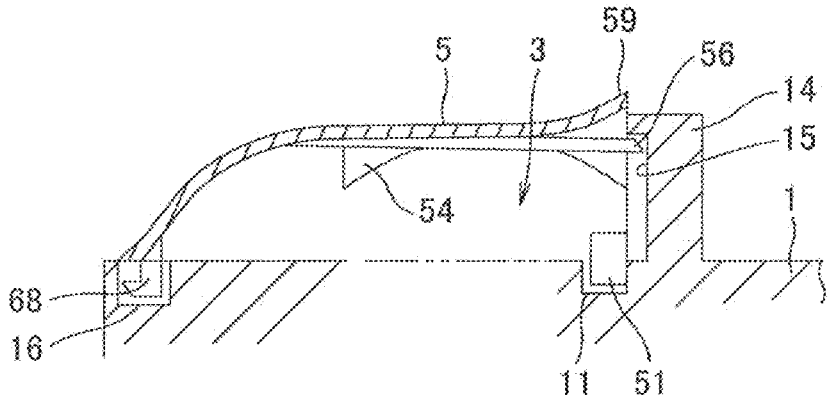
FIG. 6 is a cross sectional view showing an engagement part of a battery lid of the battery receiving mechanism.

The housing 1 and the battery lid 5 each include an engagement part which engages each other by pushing in the battery lid 5 in a direction intersecting with the side surface of the housing 1 (i.e., a direction perpendicular to the outer surface of the housing 1 in the illustrated embodiment). As shown in FIG. 1 and FIG. 6, the engagement part on the battery lid 5 side is an engaging projection part 56 formed protruding outward the above-described cut surface from the lower surface side of the battery lid 5 at two places near the center of the cut surface of the semicircular battery lid 5, that is, near a portion corresponding to the chord of the semicircle. The engagement part on the housing 1 side refers to a pair of engaging recessed parts 15 with which the pair of engaging projection parts 56 engages. The engaging recessed part 15, as shown in FIG. 6, is formed in the side surface of a center wall 14 which is vertically formed together with the battery lid 5 so as to cut the side surface of the substantially elliptic housing 1 into two parts. The battery lid 5 comprises a material with an adequate elasticity, for example, plastic.

Figure 11:
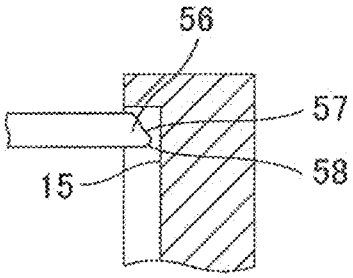
FIG. 11 is an enlarged cross-sectional view showing the engagement portion of the battery lid in the battery receiving mechanism.
Figure 12:
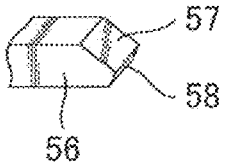
FIG. 12 is an enlarged perspective view showing an engaging projection part in the battery receiving mechanism.

FIG. 11 shows the details of the engaging projection part 56 and engaging recessed part 15, while FIG. 12 shows the detail of the engaging projection part 56. As shown in FIG. 11 and FIG. 12, the tip section of the engaging projection part 56 comprises a downwardly inclined surface 57 and an upwardly inclined surface 58, toward the projecting direction of the engaging projection part 56. The downwardly inclined surface 57 is on the upper side of the engaging projection part 56 and occupies most of the thickness in the vertical direction, and the upwardly inclined surface 58 occupies the rest of the thickness.

At both ends of the above-described cut surface of the semicircular battery lid 5, that is, at both ends of a portion corresponding to the chord of the semicircle, there is formed a pair of guide projections 51 integrally formed by projecting in the thickness direction of the battery lid 5 from the battery lid 5. On the housing 1 side, there is formed a pair of guide holes 11, into which the guide projections 51 fit while being guided when the battery lid 5 is put on the battery receiving portion 3. The guide holes 11 are formed adjacent to the base part of the center wall 14 of the housing 1.

Figure 5:
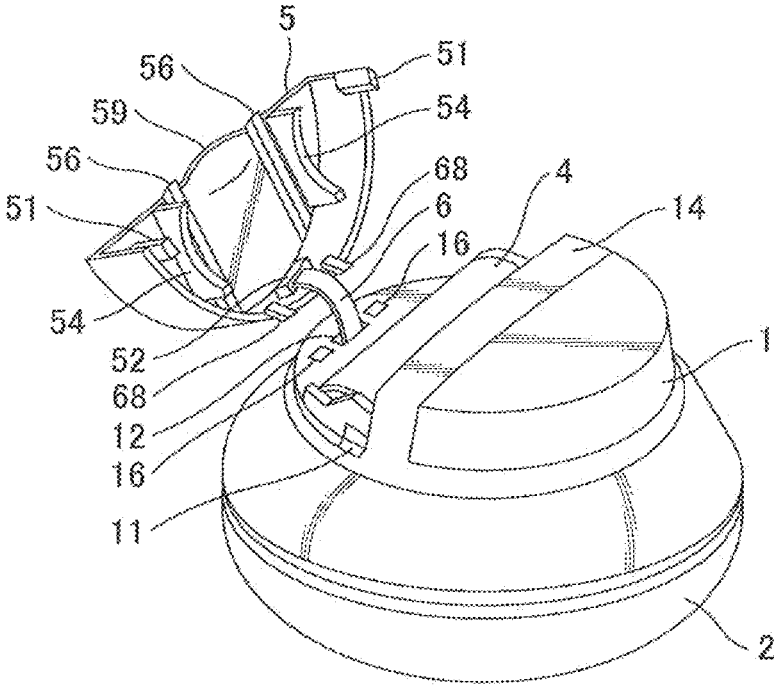
FIG. 5 is a perspective view of the noise cancellation headphone showing yet another operation mode of the battery receiving mechanism.

As shown in FIG. 5 and FIG. 6, a positioning hole 16 for positioning the battery lid 5 relative to the housing 1 when the battery lid 5 is put on the battery receiving portion 3 is formed in the housing 1, and a positioning projection 68 fitting into the positioning hole 16 is formed in the battery lid 5. The positioning hole 16 and positioning projection 68 are formed in two places, respectively. The positioning hole 16 is formed on the side of the battery receiving portion 3 of the housing 1, while the positioning projection 68 is formed in the position near the center in the circular direction of the semi-elliptic side wall of the battery lid 5.

When the battery lid 5 is put on the battery receiving portion 3, the battery lid 5 is aligned with the housing 1 by fitting the pair of positioning projections 68 into the pair of positioning holes 16, and then the pair of guide projections 51 is fitted into the pair of guide holes 11, and then the battery lid 5 is pushed into the housing 1 in a direction intersecting with the side surface of the housing 1 while the guide projection 51 is guided to the guide hole 11. At this time, the pair of engaging projection parts 56 abut against the upper edge of the center wall 14 of the housing 1, and the battery lid 5 deforms due to its flexibility, the upwardly inclined surface 58 of the engaging projection part 56 is recessed along the side surface of the center wall 14 and, as a result, the engaging projection part 56 fits into the engaging recessed part 15.

In this way, the battery lid 5 is maintained in such a state where it covers the battery receiving portion 3, by the pair of positioning holes 16 being fitted into the pair of positioning projections 68, the pair of guide projections 51 being fitted into the pair of guide holes 11, and the engaging projection part 56 being fitted into the engaging recessed part 15. In this state, unless a force attempting to detach the battery lid 5 from the battery receiving portion 3 is intentionally applied, the battery lid 5 does not disengage from the housing 1 even if a large external force is unexpectedly applied to the battery lid 5.

There is also an advantage that an unexpected external force in a direction attempting to remove the battery lid 5 is not applied to the battery lid 5 because the battery lid 5 occupies only a part of the side surface of the housing 1.

In the center portion of a linear edge corresponding to the chord of the semi-elliptic battery lid 5, a smooth outwardly-raised portion 59 is integrally provided. The raised portion 59 is provided so that the fingers of a user may be easily caught and the user may easily open the battery lid 5, when opening the battery lid 5. The raised portion 59 projects above the upper surface of the center wall 14 in a state where it covers the battery receiving portion 3, as shown in FIG. 6.

From a state where the battery lid 5 covers the battery receiving portion 3, when the battery receiving portion 3 is opened by removing the battery lid 5, for example, in order to replace the battery 4, a fingertip or a nail is put on the raised portion 59 of the battery lid 5 to pull up the raised portion 59. The battery lid 5 is pried open while deforming so as to turn around the fitting part between the pair of positioning holes 16 and the pair of positioning projections 68. At this time, the downwardly inclined surface 57 of the engaging projection part 56 moves upward along the side surface of the center wall 14 so that the engaging projection part 56 disengages from the engaging recessed part 15. Furthermore, the pair of guide projections 51 also disengages from the pair of guide holes 11. In this manner, the battery lid 5 is freed from the housing 1 and the battery receiving portion 3 is opened.

If the battery lid 5 is separated from the housing 1 with the battery receiving portion 3 open, the battery lid 5 is likely to be lost, and therefore, the battery lid 5 includes the flexible connecting member 6 for preventing the battery lid 5 from dropping off from the housing 1 in a state where the battery lid 5 opens the battery receiving portion 3. As shown in FIG. 1, FIG. 4, FIG. 5, and FIG. 7, the connecting member 6 is a plate-like member comprising a flexible plastic or the like and includes, at both ends thereof, cylindrical latching portions 61, 62 extending to both sides wider than the width of this plate-like member. The latching portions 61, 62 are latched to a receptacle of the housing 1 and a receptacle of the battery lid 5, respectively. The receptacle on the housing 1 side is a receptacle hole 12, while the receptacle on the battery lid 5 side has a confining structure comprising hook-shaped projections 52, 60 confining the latching portion 62 of the connecting member 6.

The receptacle hole 12 is a rectangular hole shorter than the length of the latching portion 61 of the connecting member 6 which is formed through the side surface of the housing 1. By fitting the latching portion 61 of the connecting member 6 into the receptacle hole 12 while the latching portion 61 is forcibly deformed through the use of its flexibility, one end of the connecting member 6 is connected to the housing 1.

Figure 7:
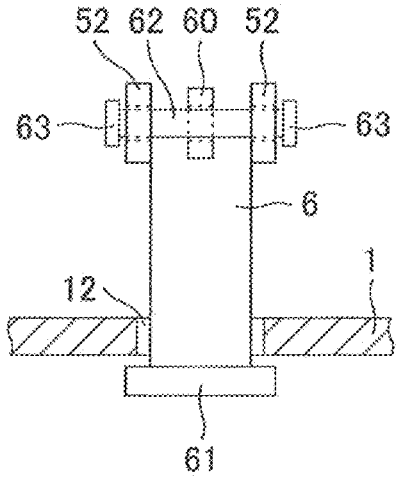
FIG. 7 is a partial cross-sectional front view showing a connecting structure portion between a housing and the battery lid of the battery receiving mechanism.
Figure 8:
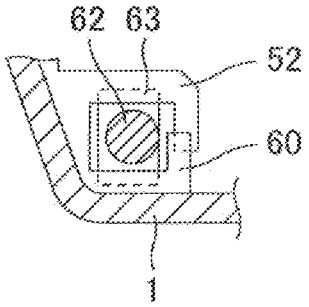
FIG. 8 is an enlarged cross-sectional side view showing the connection portion between the battery lid and the connecting member in the battery receiving mechanism.
Figure 9:
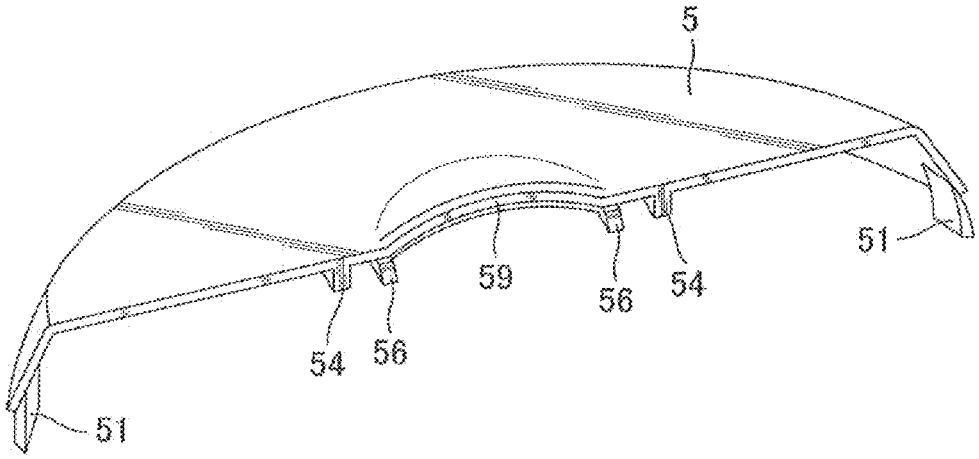
FIG. 9 is a perspective view showing the battery lid in the battery receiving mechanism.
Figure 10:
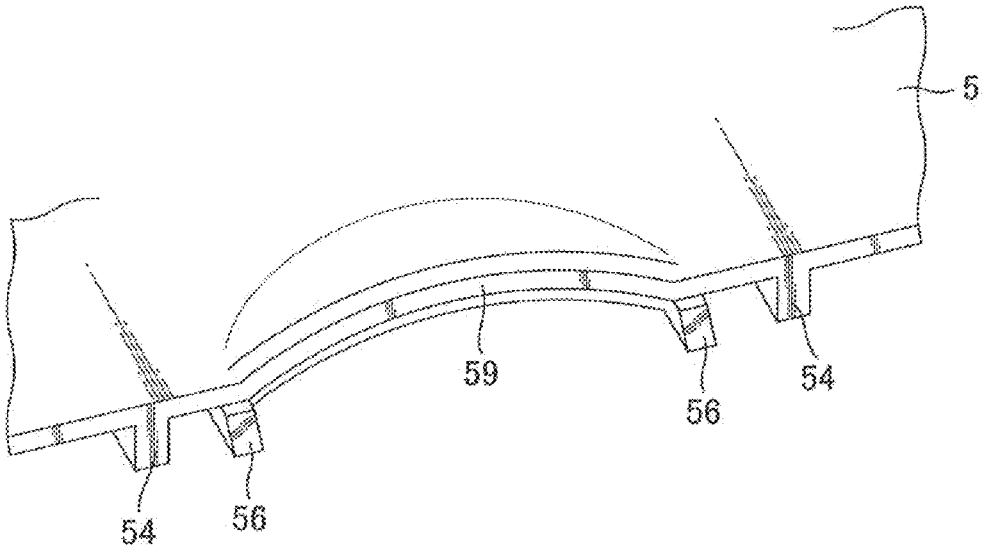
FIG. 10 is an enlarged perspective view showing a part of the battery lid.

The hook-shaped projections 52, 60 confining the latching portion 62 of the connecting member 6 of the battery lid 5, as shown in FIG. 7, comprises: a pair of hook-shaped projections 52 integrally formed with the battery lid 5 in response to both ends in the length direction of the latching portion 62; and one hook-shaped projection 60 integrally formed with the battery lid 5 in response to the center part in the above-described length direction. As shown in FIG. 8, the pair of hook-shaped projections 52 has a hook shape rectangularly bending from the upper side to the lower side, while the projection 60 has a hook shape rectangularly bending from the lower side to the upper side. When these projections 52, 60 are viewed from the length direction of the latching portion 62 to be engaged with these projections, a space surrounded by the respective projection 52, 60 is formed. By confining the latching portion 62 in this space, the other end of the connecting member 6 is connected to the battery lid 5.

In order to fit the latching portion 62 of the connecting member 6 into the space surrounded by the respective projections 52, 60, the latching portion 62 is fitted from a space formed between the projections 52, 60 utilizing the flexibility of the connecting member 6. The end on the latching portion 62 side of the main body of the connecting member 6 is fitted between the pair of projections 52 so that the movement to the width direction of the connecting member 6 is restricted. Accordingly, the latching portion 62 does not easily drop off from the hook-shaped projections 52, 60. However, in order for the battery lid 5 and the connecting member 6 not to separate from each other by any chance in a e state where the battery lid 5 opens the battery receiving portion 3, in the illustrated embodiment, a flange 63 protruding to the outside of the space surrounded by the respective projections 52, 60 is integrally formed at both ends in the length direction of the latching portion 62. The flanges 63 on both ends of the latching portion 62 are positioned on the outer side of the pair of projections 52, and thus the flange 63 prevents the latching portion 62 from escaping from the space surrounded by the respective projections 52, 60. However, it is optional whether to provide the flange 63 or not.

The connecting member 6 connecting the battery lid 5 to the housing 1 is useful in a state where the battery lid 5 opens the battery receiving portion 3, and does not function in a state where the battery receiving portion 3 closes the battery lid 5. Therefore, the connecting member 6 is short to such an extent that the operability in opening/closing the battery lid 5 is not impaired, so that in a state where the battery receiving portion 3 closes the battery lid 5, the connecting member 6 may be stored, with no difficulty, into a space formed by the battery lid 5 and the battery receiving portion 3.

The battery lid 5 can open and close the battery receiving portion 3 by being moved in the direction intersecting with the side surface of the housing 1. An engagement part maintaining a state where the battery lid 5 closes the battery receiving portion 3 has only to be provided in the battery lid 5 and the housing 1, respectively, and there is no need to provide a guide structure or guide member guiding the movement of the battery lid 5, and thus the structure of the battery receiving mechanism can be simplified. According to the advantage that there is no need to provide the guide structure or guide member, a battery housing structure immune to breakdown can be obtained because there is neither guide structure nor guide member to be damaged when a large external force is applied to the battery lid. In this manner, the structure of the battery receiving mechanism is simplified. On the other hand, the battery lid 5 is connected to the housing 1 by means of the connecting member 6 so that the battery lid 5 may not separate from the housing 1 even in the state the battery lid 5 opens the battery receiving portion 3, and so that the battery lid 5 may not be lost.

According to the connecting structures of the battery lid 5 and the housing 1 shown in FIG. 1, FIG. 4, FIG. 5, FIG. 7, and FIG. 8, even if a large external force is applied to the battery lid 5 and accordingly the battery lid 5 is damaged, the battery lid 5 has only to be replaced. Thus, there is an advantage of easy repair. Since the connecting member 6 has flexibility, if the connecting member 6 is extracted from the hook-shaped projections 52, 60 of the battery lid 5 while deforming the latching portion 62 at the end of the connecting member 6, then the damaged battery lid 5 can be discarded. The latching portion 62 of the connecting member 6 has only to be connected to the projections 52, 60 of the replaced battery lid 5. The connecting member 6 can be replaced and its replacement procedure is also easy.

As shown in FIG. 5, a pair of semicircular arch-shaped battery pressing ribs 54 are integrally formed on the inner surface side of the battery lid 5. In a state where the battery receiving portion 3 is covered with the battery lid 5, the battery pressing rib 54 presses down the battery 4, which is loaded in the battery receiving portion 3, near both ends in the length direction of the battery 4.

Note that, for the engagement parts of the housing 1 and the battery lid 5, the engagement part on the housing 1 side may be the engaging projection part and the engagement part on the battery lid 5 side may be the engaging recessed part into which the engaging projection part fits.

The side shape of the housing 1 including the battery lid is not limited to an elliptic shape, but may be a circle or other arbitrary shape.

The projection amount from the housing 1 of the engaging projection part 56 may be determined in consideration of the operability in opening and closing the battery receiving portion 3 by means of the battery lid 5 and the unremovability of the battery lid 5 when the battery lid 5 closes the battery receiving portion 3.

The present invention provides a unique structure as the structure of the battery receiving mechanism in a noise cancellation headphone. The battery receiving mechanism with such a structure can be used as the battery receiving mechanism for not only the noise cancellation headphone but also an ear muff having an active noise cancellation function, and other generic devices making use of a battery.

What is claimed is:

1. A battery receiving mechanism for a noise cancellation headphone, in which the noise cancellation headphone includes, respectively, on the right and left thereof, a housing having a speaker unit incorporated therein, both housings are connected to each other with a headband, and a battery receiving portion is provided on a side surface of at least one of the right and left housings, the battery receiving mechanism comprising:

a battery lid opening and closing the battery receiving portion; and a flexible connecting member preventing the battery lid from dropping off from the housing in a state where the battery lid opens the battery receiving portion, wherein the housing and the battery lid each include an engagement part which engages with each other by pushing in the battery lid in a direction intersecting with the side surface of the housing, wherein the battery lid occupies only a part of the side surface of the housing, and wherein the engagement part on the housing is an engaging recessed part and the engagement part on the battery lid is an engaging projection part which fits into the engaging recessed part and engages with an edge of the engaging recessed part due to an elastic force.

2. The battery receiving mechanism for a noise cancellation headphone according to claim 1, wherein the engaging projection part includes a downwardly inclined surface and an upwardly inclined surface, toward a projection direction.

3. The battery receiving mechanism for a noise cancellation headphone according to claim 1, wherein the connecting member is a plate-like member, and includes, at both ends, a latching portion extending to both sides wider than a width of this plate-like member, and wherein the latching portion is latched to a receptacle of the housing and a receptacle of the battery lid.

4. The battery receiving mechanism for a noise cancellation headphone according to claim 3, wherein the receptacle on the housing side is a receptacle hole, and wherein the receptacle on the battery lid side has a confining structure comprising a hook-shaped projection confining the latching portion of the connecting member.

5. The battery receiving mechanism for a noise cancellation headphone according to claim 4, wherein the latching portion of the connecting member can be removably attached to the receptacle of the housing and the receptacle of the battery lid, respectively, due to its flexibility.

6. The battery receiving mechanism for a noise cancellation headphone according to claim 3, wherein the latching portion of the connecting member can be removably attached to the receptacle of the housing and the receptacle of the battery lid, respectively, due to its flexibility.

* * * * *